US008579498B2

(12) United States Patent
Ferrara et al.

(10) Patent No.: US 8,579,498 B2
(45) Date of Patent: Nov. 12, 2013

(54) HIGH EFFICIENCY ESCAPEMENT

(76) Inventors: Carlo Ferrara, Rome (IT); Fiammetta Ferrara, legal representative, Rome (IT); Sergio Ferrara, Rome (IT)

( * ) Notice: Subject to any disclaimer, the term of this patent is extended or adjusted under 35 U.S.C. 154(b) by 0 days.

(21) Appl. No.: 13/511,635

(22) PCT Filed: Oct. 25, 2010

(86) PCT No.: PCT/IB2010/054812
§ 371 (c)(1),
(2), (4) Date: Feb. 6, 2013

(87) PCT Pub. No.: WO2011/064682
PCT Pub. Date: Jun. 3, 2011

(65) Prior Publication Data

US 2013/0176830 A1 Jul. 11, 2013

(30) Foreign Application Priority Data

Nov. 25, 2009 (IT) ..... RM2009A0621

(51) Int. Cl.
*G04B 15/08* (2006.01)
*G04B 15/14* (2006.01)

(52) U.S. Cl.
USPC ..... 368/127; 368/132

(58) Field of Classification Search
USPC ..... 368/127, 129, 130, 132, 133
See application file for complete search history.

(56) References Cited

U.S. PATENT DOCUMENTS

| | | | | |
|---|---|---|---|---|
| 54,277 | A | 5/1866 | Bacon | |
| 2,907,168 | A * | 10/1959 | Inotsume | 368/130 |
| 3,538,705 | A * | 11/1970 | Perry | 368/125 |
| 2005/0122848 | A1 * | 6/2005 | Hayek et al. | 368/127 |
| 2008/0259739 | A1 * | 10/2008 | Jurin et al. | 368/131 |
| 2008/0279052 | A1 | 11/2008 | Rochat et al. | |
| 2008/0298180 | A1 | 12/2008 | Conus et al. | |
| 2009/0168611 | A1 * | 7/2009 | Gigandet et al. | 368/130 |

FOREIGN PATENT DOCUMENTS

| | | |
|---|---|---|
| CH | 502638 | 10/1970 |
| EP | 1710636 | 10/2006 |
| EP | 1998236 | 12/2008 |
| GB | 146009 | 7/1920 |

OTHER PUBLICATIONS

PCT International Search Report for PCT/IB2010/054812 filed on Oct. 25, 2010 in the name of Carlo Ferrara with a mailing date of Apr. 5, 2011.

PCT Written Opinion for PCT/IB2010/054812 filed on Oct. 25, 2010 in the name of Carlo Ferrara with a mailing date of Apr. 5, 2011.

* cited by examiner

*Primary Examiner* — Amy Cohen Johnson
*Assistant Examiner* — Matthew Powell
(74) *Attorney, Agent, or Firm* — Young & Thompson

(57) ABSTRACT

A mechanical device for horology, comprising angular reduction means apt to decrease the oscillation of the width of the lever pacing the motion of the gear.

8 Claims, 7 Drawing Sheets

HIGH EFFICIENCY ESCAPEMENT

CROSS REFERENCE TO RELATED APPLICATIONS

The present application is the US national stage of International Application PCT/IB2010/054812 filed on Oct. 25, 2010, which, in turn, claims priority to Italian Patent Application RM2009A000621 filed on Nov. 25, 2009.

The present invention refers to a mechanical device apt to make a continuous rotary motion paced, particularly suitable for application in the horology field.

Techniques are known which exploit mechanisms of transformation of continuous rotary motions into paced rotary motions, based on the coupled use of gears and mechanical devices called "escapements", which alternate steps of pushing one tooth of the gear to steps of locking another one thereof. The most widely known escapements are the so-called crown wheel one, consisting of a wheel having a toothed and raised edge, like a crown, and a shaft orthogonal to the axis and transversal to the edge of the crown wheel, or the anchor one, similar to the preceding one, yet differing in that verges do not get stuck on the crown wheel, locking the axis, but merely mesh therein. Moreover, so-called "dead-beat" escapements are known, in which the mutual shape of the teeth of the crown and of the verges is such as to separate the task of adjusting the rate from that of transferring energy to the oscillator in order to keep it in motion.

Several solutions concerning the escapement have been proposed; however, many of them entail potential margins of improvement with regard to the isochronism, i.e., the ability to transform the continuous rotary motion into a paced motion having a period as constant as possible.

Therefore, the technical problem solved by the present invention is that of providing a mechanical device capable of improving the above-mentioned isochronism property, allowing to obtain a margin of improvement with reference to the known art.

Such a problem is solved by a mechanical device according to claim 1.

Preferred features of the present invention are set forth in the dependent claims thereof.

The present invention provides some relevant advantages.

The main advantage lies in that the proposed system, by doubling the lever commonly used in the connection of the gear with the balance wheel into two components articulated therebetween, allows performing an angular reduction ratio in the connection between the lever and the balance wheel, with an entailed improvement of the efficiency of the entire process.

Other advantages, features and the operation modes of the present invention will be made apparent in the following detailed description of some embodiments thereof, given by way of example and not for limitative purposes. Reference will be made to the figures of the annexed drawings, wherein.

Figure 1:
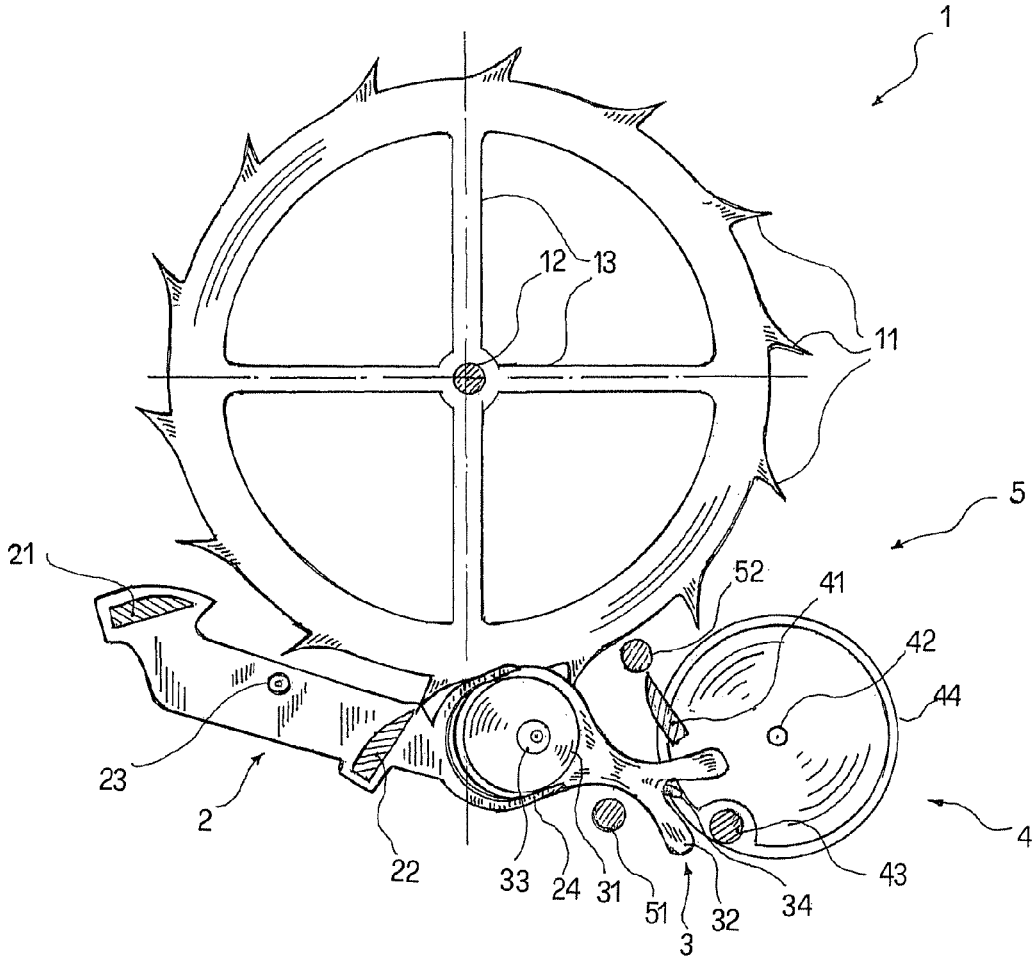
FIG. 1 shows a plan view of a first embodiment of the mechanical escapement device according to the present invention.
Figure 2:
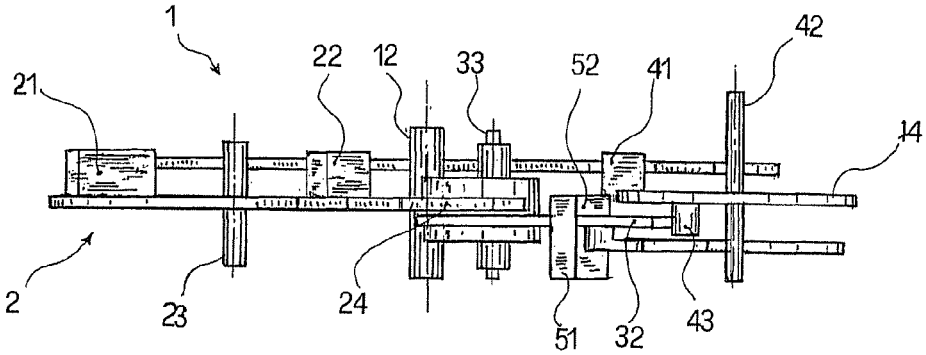
FIG. 2 shows a side view of said first embodiment of the mechanical escapement device according to the present invention.

Referring initially to FIGS. 1 and 2, a mechanical escapement device according to a first embodiment of the invention is generally denoted by 5.

The mechanical escapement device 5 is suitable for transforming a continuous rotary motion into a paced rotary motion, characterized by a high level of isochronism.

The mechanical escapement device 5, of which FIGS. 1 and 2 depict a first embodiment, is mainly devised for use within the scope of mechanical horology.

The mechanical escapement device 5 comprises a balance wheel 4, a rod 3, a tilting lever 2 and a rotating member 1.

The rotating member, generally denoted by 1, is apt to rotate about a first axis of rotation 12 and comprises peripheral engaging (coupling) means, in particular teeth, generally denoted by 11.

According to said first embodiment, the rotating member is comprised of a gear 1 pivoted at its center 12 and characterized by arms 13 and external hypoid toothing 11.

A tilting lever, generally denoted by 2, is apt to mesh through engagement means 21 and 22 with the teeth 11 of said rotating member 1.

The tilting lever 2 is constrained to tilt about a second axis of rotation 23. The engagement means 21, 22, in the preferred embodiment, is two teeth 21, 22 whose configuration is apt to guarantee meshing with gear teeth and that, alternately, engage one of the teeth of the gear 1. The evenness of oscillations of the lever causes the pacing of the rotary motion of the gear 1.

According to this first embodiment, the device further comprises a rod 3 apt to oscillate about a second axis of rotation 33 when moved by said balance wheel 4; the latter, as it is known, can oscillate about an axis of its own, under the action of an external force and thanks to elastic return means. This operation of the balance wheel will not be detailed herein, as known to a person skilled in the art.

The balance wheel 4 comprises a finger 43 which, during the oscillations, comes in contact with an end portion of said rod 3, setting it in rotation about the axis of rotation 33, performing an oscillation of the same rod 3.

The device according to the present invention further comprises articulation means 24, 31, 33, apt to connect the rod 3 to said lever 2.

Such articulation means 24, 31, 33 transfers the oscillations of the rod 3 to the lever 2, setting it, in turn, in oscillation about the first axis of rotation 23.

Moreover, the articulation means 24, 31, 33 is such as to perform an angular reduction ratio between the oscillations of said rod 3 and the oscillations of said lever 2.

In its oscillations, the rod 3 is preferably limited by two limiting members 51 and 52, apt to prevent misalignments thereof.

The rod 3 is of elongated shape and has two ends.

According to a preferred embodiment of the mechanical device according to the present invention, the articulation means 24, 31, 33 comprises a mechanical joint with a rotary articulation apt to allow relative rototranslation between the lever 2 and said rod 3.

In particular, the articulation means 24, 31, 33 comprises a cam 31, integral to said rod 3.

The cam 31 preferably has a cylindrical contour and is mounted, integrally to the rod 3 and eccentrically with respect to the second axis of rotation 33, at a first end of the rod 3 itself.

The second end 32 of the rod 3, has a bifurcated shape, e.g., V-shaped, such as to allow interaction with said balance wheel 4, in particular with the finger 43 integral to the balance wheel.

Moreover, the balance wheel 4 is equipped with a tooth 41 apt to receive motion from the rotating member 1 through contact with the elements 11 for engaging the gear.

According to this first embodiment, the balance wheel comprises a pair of discs, integral, coaxial but not coplanar. Of the two discs, a second disc 44 has a shaping in the contour, at the finger 43 placed on the balance wheel.

The rod 3 comprises, at the center of its bifurcated end 32, a key 34 apt to come in contact with the contour of the disc 44. This is such as to limit undesired rotation of the rod 3 during oscillations of the balance wheel. The sole instant in which the rod 3 can oscillate is when the key 34 corresponds to the shaping on the disc 44.

Always according to this first embodiment, one of the two side ends of the tilting lever 2 has a yoke configuration (shape) 24 apt to guarantee cylindrical articulation between said tilting lever 2 and said rod 3.

The yoke 24 is such as to embrace the cam 31 that, by rotating eccentrically with respect to the axis of rotation 33, causes a corresponding rotation of the lever 2. Eccentricity generates the desired reduction ratio between the rotation of the rod and the corresponding rotation of the lever.

Hereinafter, the operation of the mechanical escapement device 5 will be described.

The mechanical escapement device, subject-matter of the present invention, operates as described hereinafter.

Figure 3A:
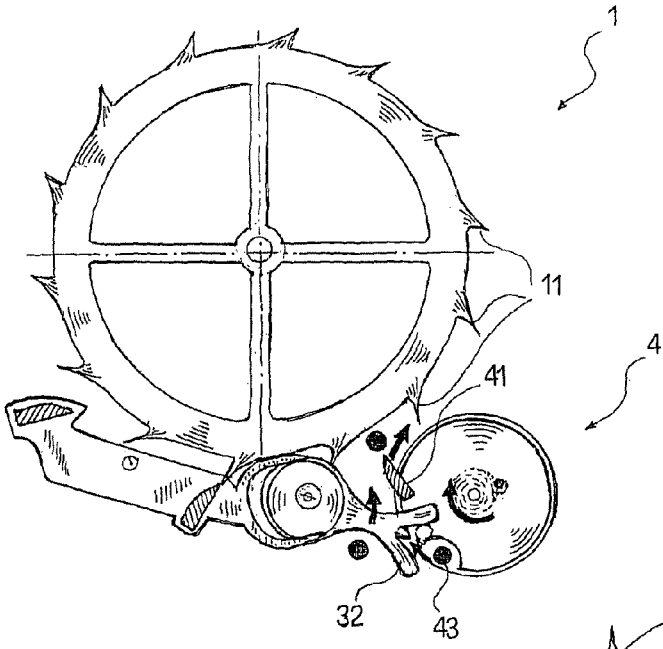
FIGS. 3A, 3B, 3C, 3D and 3E show a plan view of operation steps of the mechanical escapement device according to the present invention.

In a first step, depicted in FIG. 3A, the balance wheel 4, by rotating clockwise with respect to the viewpoint of said FIG. 3A, brings the finger 43 to fit at the center of the "V" of the bifurcated portion 32.

Concomitantly, the rotation of the balance wheel 4 causes the tooth 41 to get near the tooth 11 of the gear 1. The finger 43, by pushing on the bifurcated portion 32, causes a counterclockwise rotation thereof, depicted in FIG. 3B.

The bifurcated portion 32 is connected, by a rotary articulation, to the cam 31. Accordingly, the rod 3 rotates clockwise, as depicted in FIG. 3B.

Said articulation allows rototranslation between the two members 2 and 3 and is carried out, due to the eccentricity in the pivoting of said cam 31, with an angular reduction in the oscillation width of the rod 3 with respect to the lever 2.

In particular, an oscillation of said rod 3 having a width of about 45° is reduced, through said reduction means, to an oscillation of said lever 2 of about 5°.

Figure 3B:
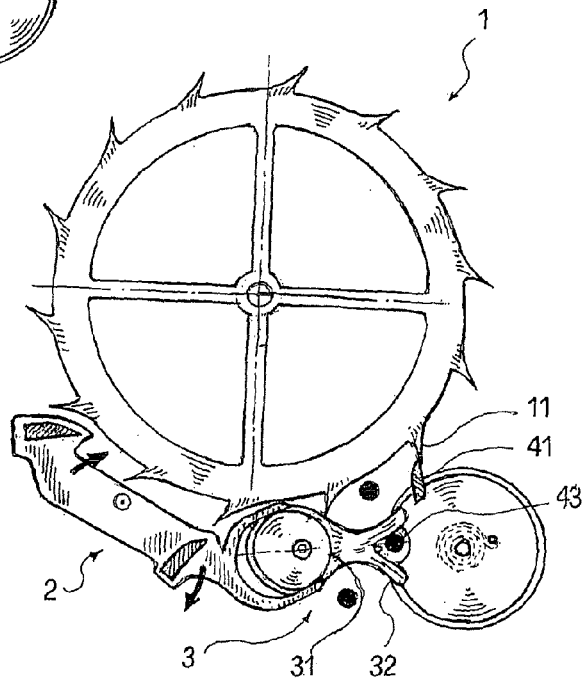
Figure 3C:
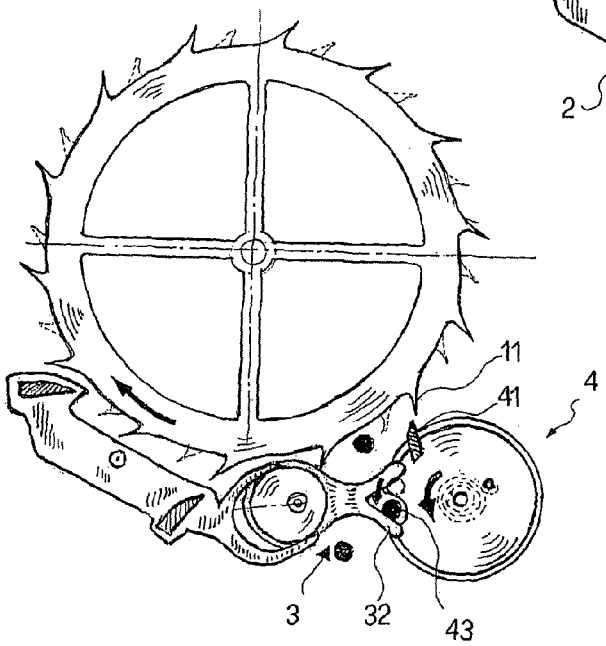

FIG. 3B also describes the step in which said gear 1 pushes said balance wheel 4 through the contact between said teeth 11 and 41. Following said push, the balance wheel 4 rotates counterclockwise and the finger 43 presses against the bifurcated portion 32 of said rod 3, as depicted in FIG. 3C. Therefore, the rod 3 rotates clockwise.

Figure 3D:
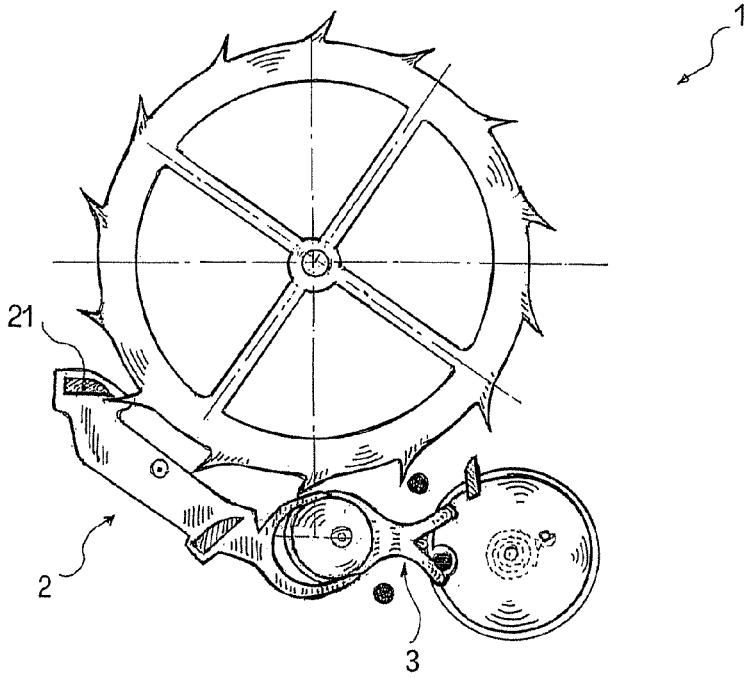

By effect of the rotary articulation, the clockwise rotation of said rod 3 causes a counterclockwise rotation of the lever 2 which brings said tooth 21 to engage the gear 1, causing a temporary stop thereof as depicted in FIG. 3D.

Figure 3E:
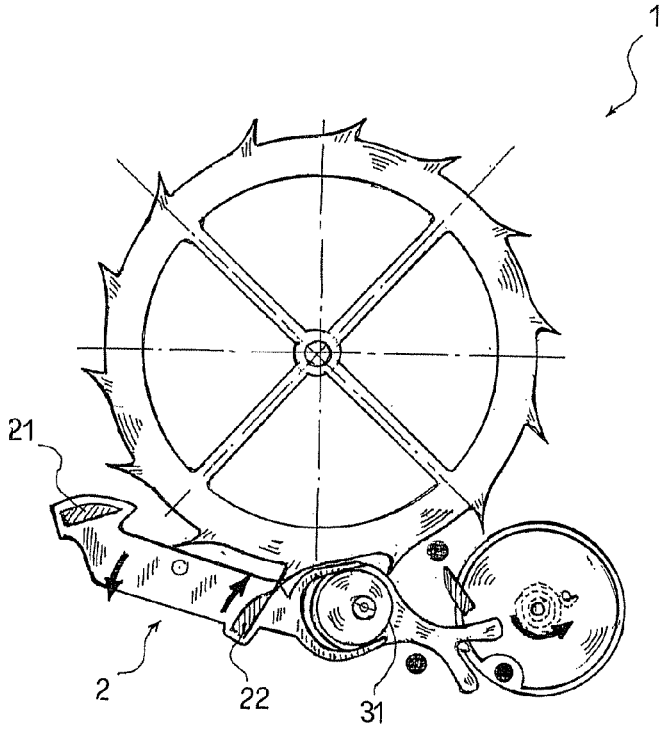

In FIG. 3E, the clockwise rotation of said cam 31 brings said lever 2 to rotate counterclockwise, with consequent contact of said tooth 22 to engage said gear 1.

Said motion steps repeat continuously, thereby performing a pacing dictated by the temporary stops of the gear, dictated by the teeth 21, 22. Being a high-efficiency system, it needs less energy, entailing a thinner spring, which determines less friction, less component wear and a slower ageing.

Therefore, it will be appreciated that the mechanical escapement device entails the following advantages with respect to the common mechanical escapements:

- greater precision;
- better isochronism properties;
- energy saving, entailing the option of using thinner and longer springs with a consequent greater autonomy of the watch;
- absence of lubrication needs;
- longer revision intervals.

Figure 4:
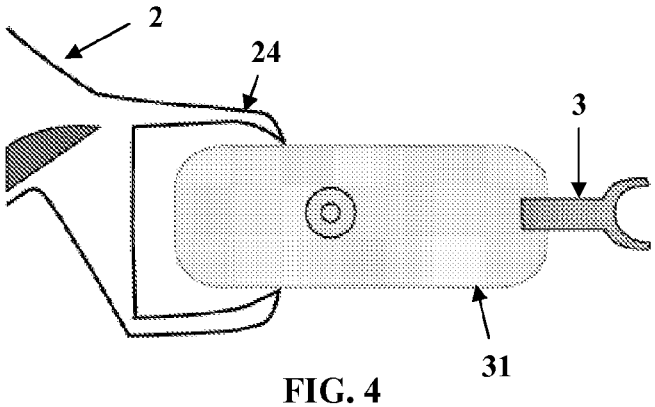
FIG. 4 shows a detail view of a variant of the device according to the present invention.

FIG. 4 shows an alternative configuration of some components of the device described hereto. As in the first embodiment, one of the two side ends of the tilting lever 2 has a yoke configuration (shape) 24 apt to guarantee articulation between the tilting lever 2 and the rod 3.

Moreover, the articulation means 24, 31, 33 comprises a cam member 31, integral to the rod 3, and having an eccentric axis of rotation which is positioned outside the yoke 24. Thus, the cam 31, along with the rod 3, overall forms a lever which, by cooperating with the shape 24, produces substantially the same effect of the described joint. Actually, it is however performed an angular reduction ratio between the oscillations of the rod 3 and the oscillations of the lever 2.

Figure 5A:
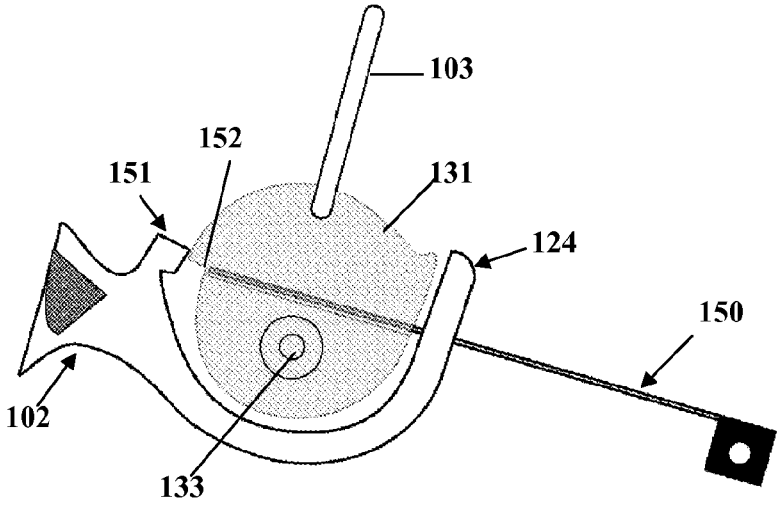
FIGS. 5A and 5B show detail views of a second embodiment of a device according to the present invention.
Figure 5B:
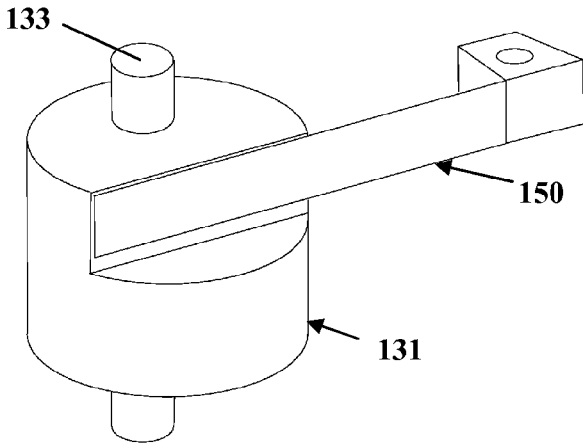

FIGS. 5A and 5B refer to a second embodiment of a device according to the present invention.

This second embodiment in no way modifies the general operation principle of the device, but the configuration of some of its components is such as to make the operation thereof even more effective.

In particular, modifications mainly concern the joint between the lever 102 and the rod 103, made however by means of a cam 131 cooperating with a yoke-shaped portion 124 of the lever 102.

Hereinafter, with reference to FIGS. 6A-6E, the operation of this second embodiment of a device according to the present invention will be described, without however delving into detail of the operation in general, which remains that already described in the foregoing.

FIGS. 6A-6E are representative of an operation cycle, which then continuously repeats itself over time.

Figure 6B:
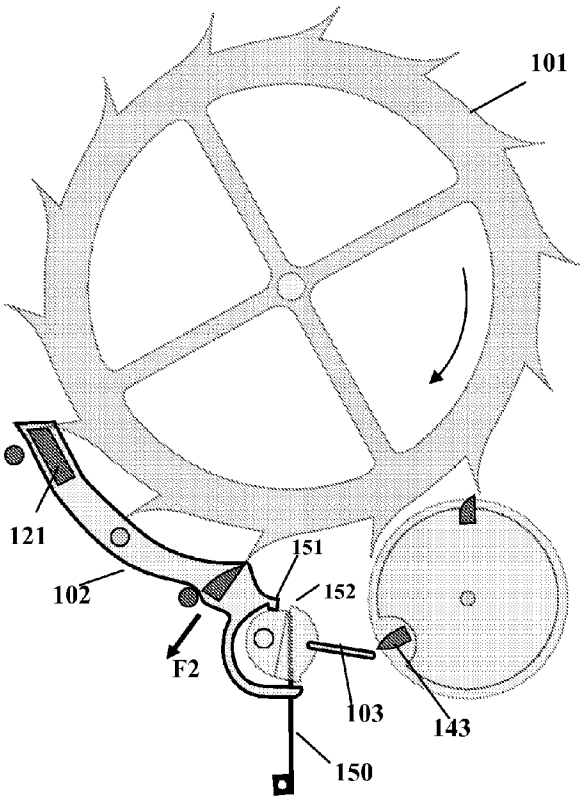
FIGS. 6A, 6B, 6C, 6D and 6E show a device according to the second embodiment in the different operation steps.
Figure 6A:
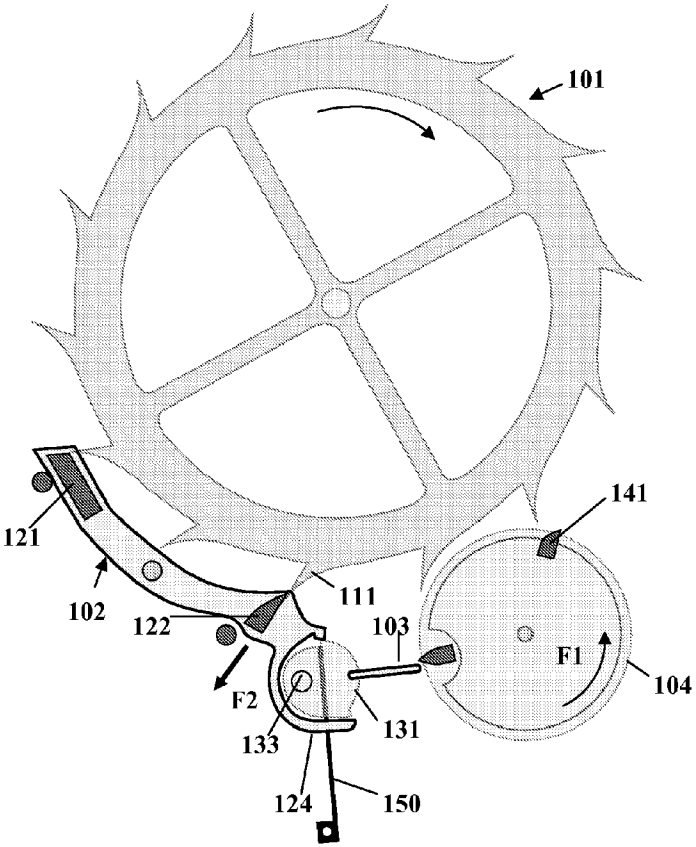

Starting from the step in FIG. 6A, the balance wheel 104 is in counterclockwise rotation, as indicated by arrow F1.

A finger 143, integral to the balance wheel, intercepts the rod 103, causing rotation of the cam 131 about the axis of rotation 133.

To the rotation of the cam an elastic force is opposed, in the specific instance exerted by a spring 150, e.g. of foil type.

The rotation of the cam 131 determines, analogously to what has been described hereto, the rotation of the lever 102 along the direction indicated by arrow F2 in the figure.

Figure 6D:
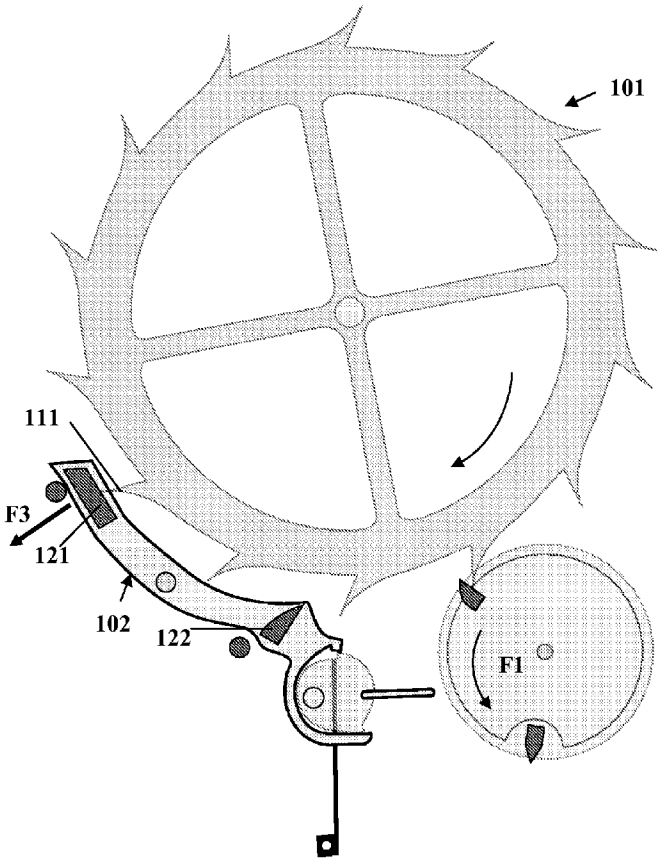
Figure 6C:
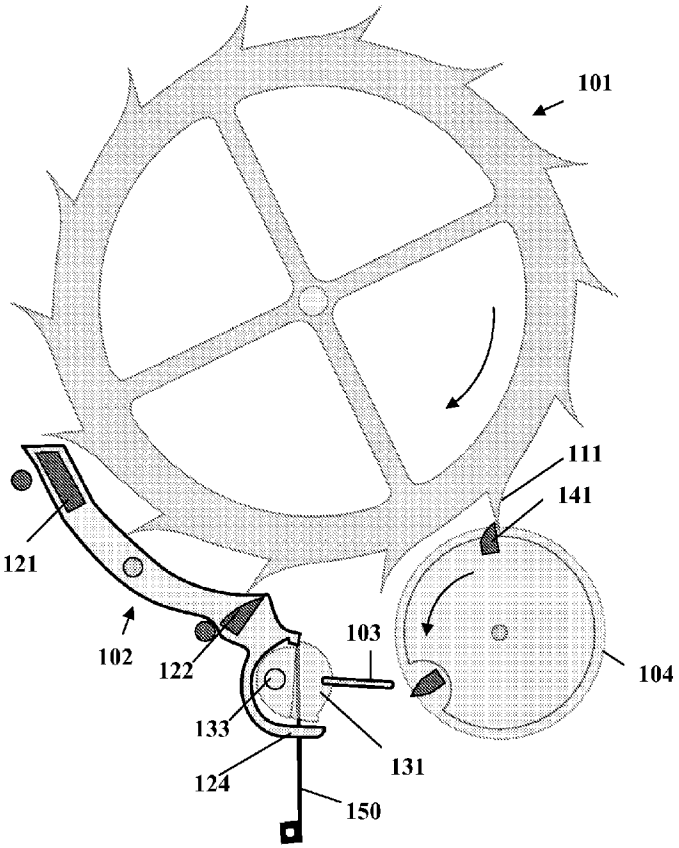

This entails the moving of the engagement tooth 122 away from the tooth 111 of the gear 101, up to its disengagement, with the lever 102 positioning itself so that an opposing portion 151 thereof abuts against the seat 152 obtained on the cam 131, as shown in FIG. 6C.

FIGS. 6B and 6C depict the reached position, in which the finger 143 of the balance wheel gradually disengages the rod 103.

Next FIG. 6D illustrates an intermediate step of the cycle, during which a tooth 111 of the gear 101 intercepts a finger 141 integral to the balance wheel 104, which therefore is pushed further in its counterclockwise rotation.

Concomitantly, the lever 102 is set in opposite rotation, as indicated by arrow F3 in the figure, thanks to the action of one of the teeth 111 of the gear which intercepts an engagement member 121 for engaging the lever itself.

With respect to the preceding embodiment, the engagement member 121 is not positioned so as to prevent rotation of the gear 101, but rather so as to constitute an engagement member for the arriving tooth 111 of the gear, such as to cause counter-rotation of the lever.

This counter-rotation brings the tooth 122 of the lever into a starting position, such as to be able to intercept the next tooth 111 of the gear 101, as it arrives.

Advantageously, the engagement member 121 is positioned so as to exploit, in positioning the lever in its starting position, the last period of the rotary impulse of the gear 101, without subtracting energy to the push that the same wheel has already imparted to the balance wheel.

Figure 6E:
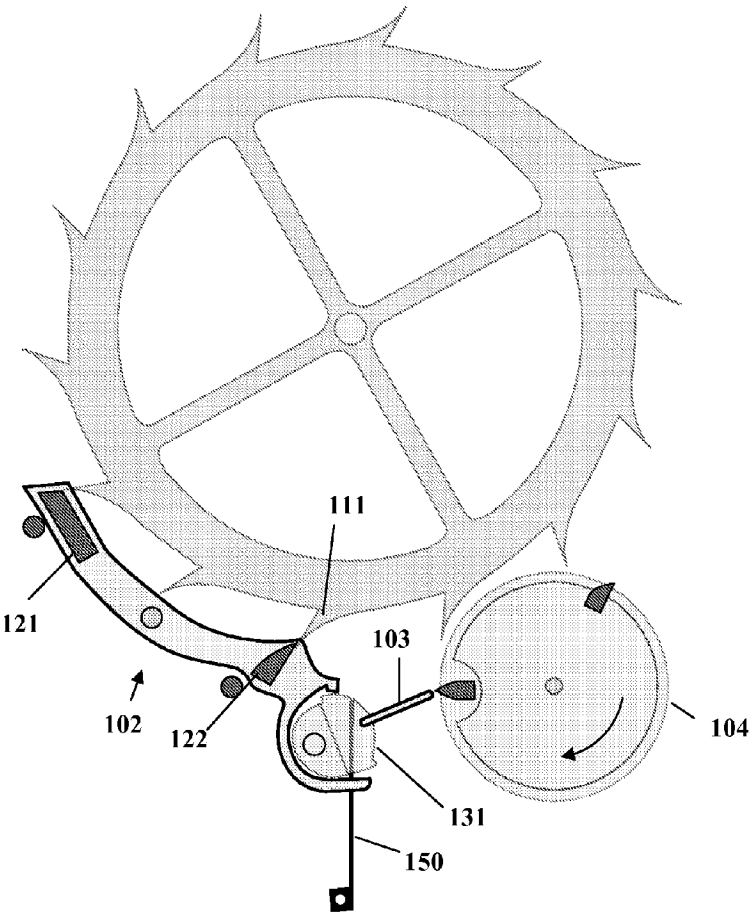

Concomitantly, the balance wheel 104, under the action of a return spring, begins its clockwise rotation, along the direction of the arrow in FIG. 6E. This clockwise rotation brings the finger 143 of the balance wheel to intercept the rod 103 and, therefore, to set the cam 131 in rotation, until restoring the situation initially described.

At this point the cycle is completed and could therefore repeat again.

Advantageously, the device according to the present invention may further comprise a mechanism for adjusting the articulation means, such mechanism being apt to allow a change of the reduction ratio.

The manufacturing of such adjusting mechanism is to be deemed within the reach of a person skilled in the art; however, it should be noted that the present invention certainly allows an adjustment extremely simplified and finer with respect to the art known to date.

Therefore, by now it will have been better appreciated that the invention overall allows to obtain a mechanical device for transforming a rotary motion into a paced rotary motion with guaranteed abilities of isochronism, energy effectiveness and precision.

The present invention has been hereto described with reference to preferred embodiments thereof. It is understood that other embodiments might exist, all falling within the concept of the same invention, as defined by the protective scope of the claims hereinafter.

The invention claimed is:

1. A mechanical device for pacing a rotary motion of a rotating toothed member, particularly suitable for applications in the horology field and the like, comprising:

a balance wheel adapted to move with an oscillatory motion; a lever tilting about a first axis of rotation and comprising engagement means adapted to cooperate with said rotating member; a rod adapted to oscillate about a second axis of rotation when moved by said balance wheel and articulation means adapted to connect said rod to said lever so as to cause corresponding oscillations thereof, performing an angular reduction ratio between the oscillations of said rod and the oscillations of said lever;

wherein said articulation means comprises: a mechanical joint with a rotary articulation adapted to allow relative rototranslation between said lever and said rod; a cam which is mounted, integrally to said rod and eccentrically with respect to the second axis of rotation; and a yoke, which embraces said cam, adapted to guarantee cylindrical articulation between said tilting lever and said rod; such that said rotary articulation being carried out through mutual motion between said yoke located at one end of said lever and said cam cooperating with said yoke.

2. The mechanical device according to claim 1, wherein said rod is equipped, at an end thereof, with a V-shaped bifurcated portion, adapted to come in contact with a finger integral to the balance wheel.

3. The mechanical device according to claim 2, wherein said rod is equipped, at the center of the bifurcated end thereof, with a key adapted to come in contact with a disc integral, coaxial and parallel to the balance wheel and adapted to limit undesired rotation of said rod.

4. The mechanical device according to claim 1 further comprising two limiting members, wherein said rod is limited in its own motion by said two limiting members which are adapted to prevent misalignments of said rod.

5. The mechanical device according to claim 1, further comprising an elastic member for returning said cam.

6. The mechanical device according to claim 5, wherein said elastic member is a leaf-type spring.

7. The mechanical device according to claim 5, wherein said yoke comprises an opposing portion adapted, in operation, to abut against a seat obtained on the cam.

8. The mechanical device according to claim 1, further comprising a mechanism for adjusting said articulation means, adapted to allow a change of said reduction ratio.

* * * * *